United States Patent [19]

Ewald et al.

[11] 3,938,711

[45] Feb. 17, 1976

[54] SELF PRIMING MECHANISM FOR DISPENSER

[75] Inventors: Ronald F. Ewald, Rolling Meadows; Raymond M. Konarski, Carpentersville, both of Ill.

[73] Assignee: Seaquist Valve Company, Cary, Ill.

[22] Filed: Sept. 16, 1974

[21] Appl. No.: 506,008

[52] U.S. Cl. ..... 222/209; 222/211; 222/382

[51] Int. Cl.[2] ..... B65D 37/00

[58] Field of Search ..... 222/209, 211, 382, 464

[56] References Cited

UNITED STATES PATENTS

| | | | |
|---|---|---|---|
| 3,225,969 | 12/1965 | O'Donnell | 222/464 |
| 3,311,274 | 3/1967 | Green | 222/464 |

*Primary Examiner*—Robert B. Reeves
*Assistant Examiner*—John P. Shannon
*Attorney, Agent, or Firm*—Stein & Orman

[57] ABSTRACT

A self priming mechanism for a dispenser comprising a container attachment and a dip tube sealer. The container attachment may comprise a screw threaded cap, a mounting cup or any of the customary means to mount a dispenser on a container and includes an upper dip tube sealer housing which communicates with a dispensing structure such as a pump or a dispensing valve. The dip tube sealer comprises a seal collar movable between an open and a closed position. The collar has a dip tube tail upon which a dip tube is mounted extending downward through the container head space and into the product to be dispensed. The attachment and the dip tube sealer cooperatively form a feedback therebetween when the flexible collar is in the open position to permit air trapped within the dip tube during assembly to escape back to the head space. They also cooperatively form a pair of sealing surfaces therebetween to prevent flow through the feedback when the flexible collar is in the closed position.

9 Claims, 8 Drawing Figures

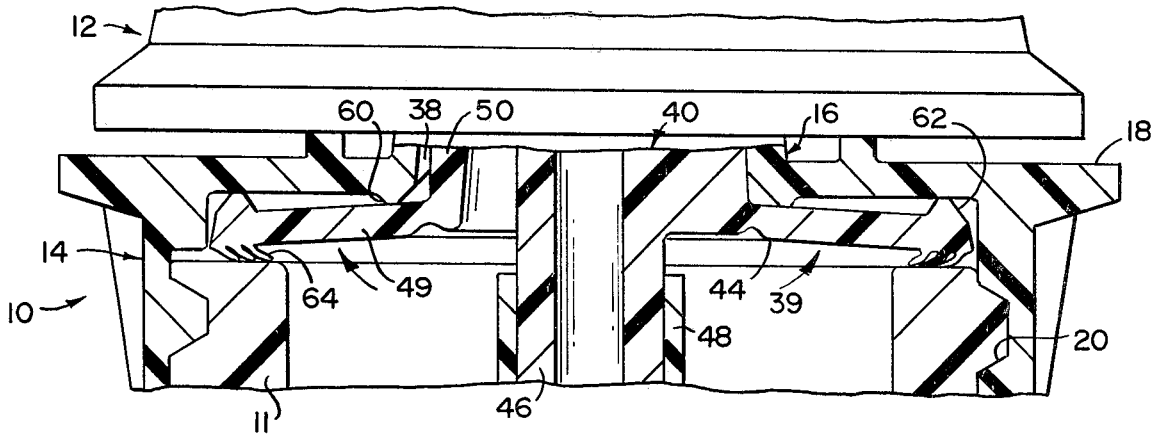
FIG. 2
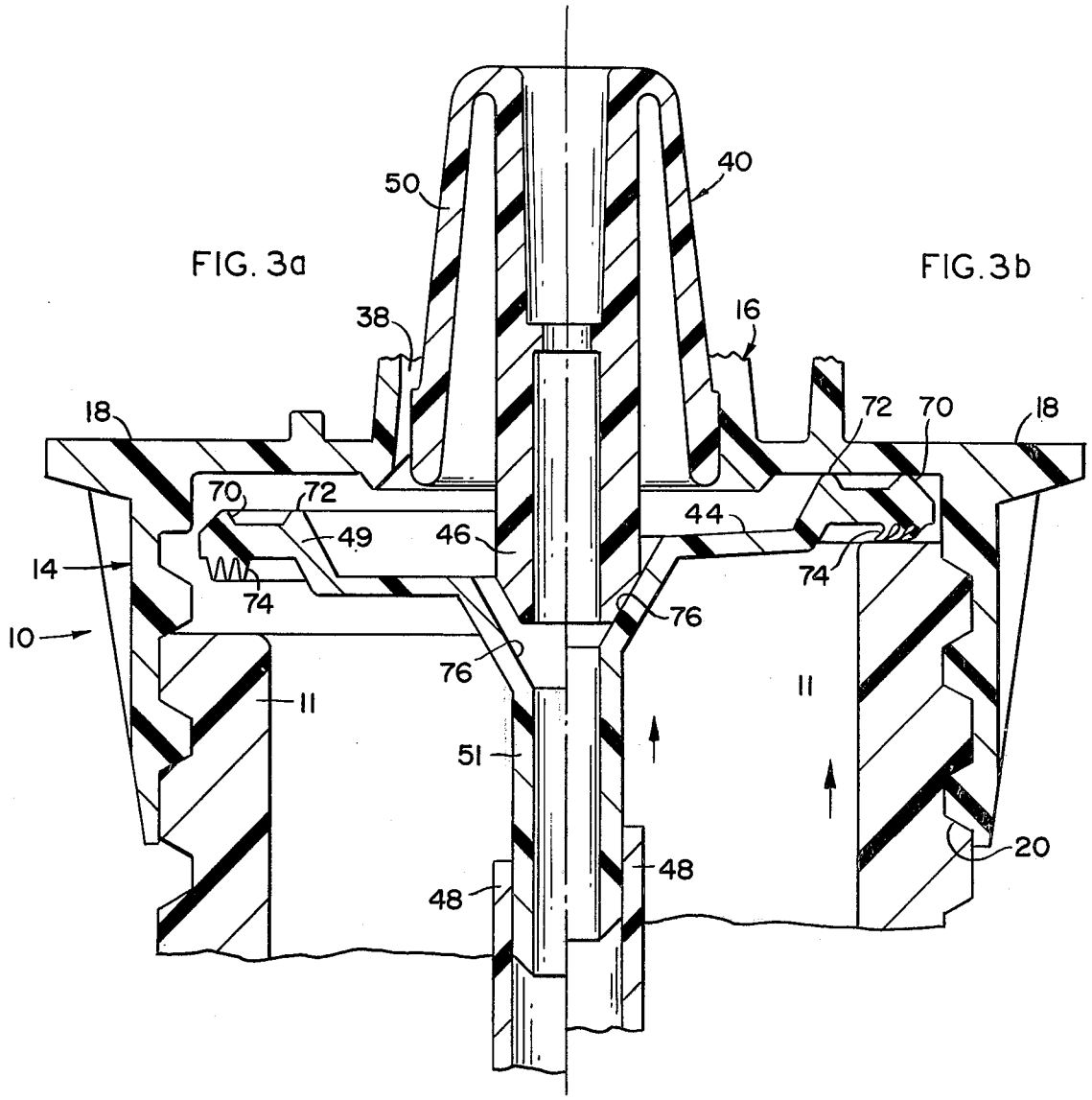

FIG. 4a
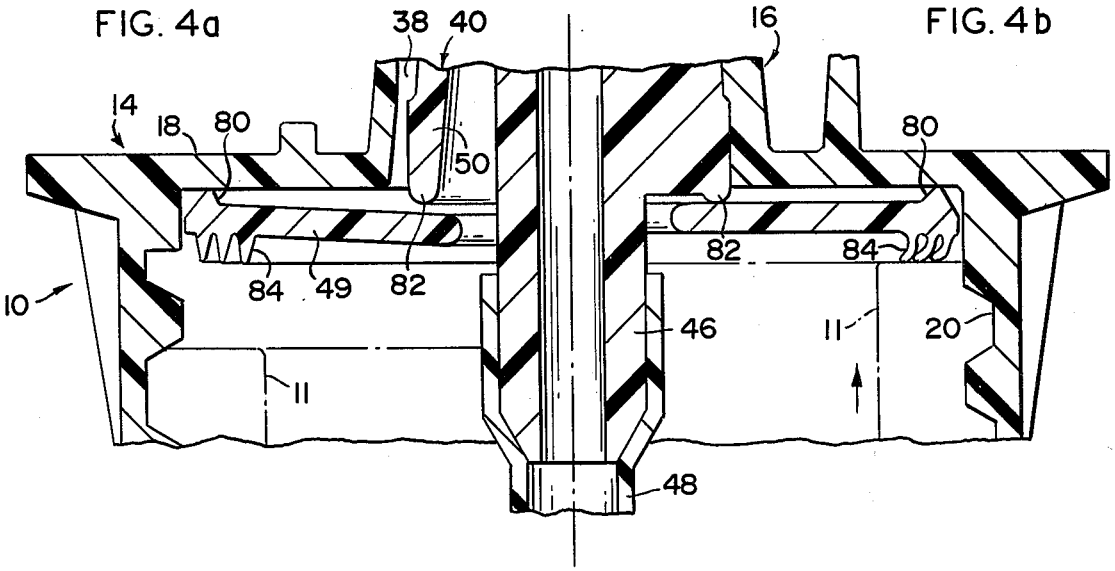
FIG. 4b
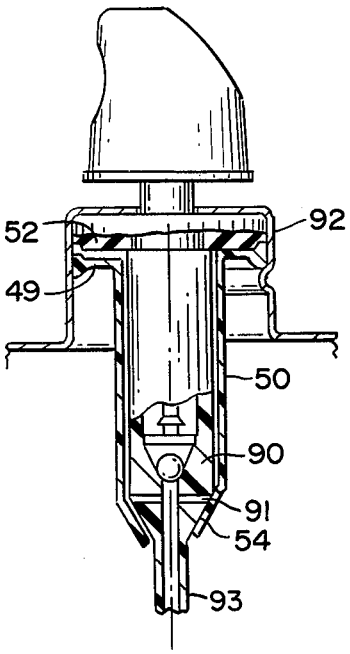
FIG. 5
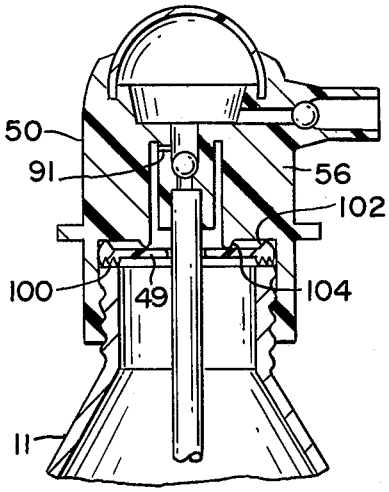
FIG. 6

SELF PRIMING MECHANISM FOR DISPENSER

BACKGROUND OF THE INVENTION

1. Field of the Invention

A self priming mechanism for use with a dispenser, such as a finger pump, a ball pump, an aerosol container, a squeeze bottle, or any dispenser which utilizes a dip tube comprising a container attachment means and a dip tube sealer which cooperatively form a feedback means therebetween to permit air trapped within the dip tube during assembly to escape and thereby act, at least partially, as a self primer when the dispenser is first actuated.

2. Description of the Prior Art

A number of products, such as window sprays, starches, hand lotions and the like are available in dispensers including finger pumps, ball pumps, squeeze bottles and aerosol containers. These dispensers frequently use dip tubes — tubes which extend into the product so that upon actuation the product travels up the tube and out the terminal orifice.

A problem common to these dispensers is the difficulty in priming especially during first actuation. This is a result of the air generally trapped in the dip tube during assembly. Thus, a need exists for a means of eliminating or minimizing the air trapped in the dip tube during assembly.

SUMMARY OF THE INVENTION

The present invention relates to a self priming mechanism for dispensing. More specifically, the invention relates to a self priming mechanism which comprises a dispenser attachment means and a dip tube sealer which cooperatively form a feedback passage to permit air trapped within the dip tube during assembly to be fed back to the head space of the container.

The attachment means comprises the customary cap for the dispenser container, such as a screw-on cap, a snap cap, a mounting cup or the like. The cap has a dip tube sealer housing extending therefrom usually upwardly. Its base includes fastening means to enable attachment of the mechanism to the container.

The dip tube sealer housing has a recess to receive and house the dip tube sealer. A feedback depression is formed in the ceiling of the recess and is in communication with a feedback channel formed in the side wall. These, with the dip tube sealer in place, cooperatively form a feedback passage to permit air trapped in the dip tube to be fed back to the head space of the container.

The dip tube sealer comprises a flexible collar with a dip tube tail extending downwardly therefrom. As described more fully hereinafter, the flexible collar is movable between a first or open position and second or closed position. The customary dip tube is affixed to the tail.

During assembly, the mechanism with the dispensing means utilized therewith are placed on the dispenser container with the dip tube extending through the head space and into the product with the container. Initially, the dip tube sealer is in the first or open position allowing air trapped within the dip tube to flow upward and through the feedback depression recess and channel, which constitute the feedback passage formed between the dip tube sealer housing and flexible collar and back into the head space of the container. As the mechanism and dispensing means are fastened to the container, the dip tube sealer moves from the open position to the closed or sealed position to seal the feedback passage.

In this manner, most of the air usually trapped initially within the dip tube is evacuated into the head space reducing the amount of mechanical priming necessary to actuate and dispense product. As can be understood and appreciated, the particular dispensing means may take any number of forms.

This invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 2 is a partial cross-sectional view of the mechanism of FIG. 1 with the dip tube sealer in the closed or sealed position.

FIGS. 3*a* and 3*b* are partial cross-sectional views of another embodiment of the self prime mechanism wherein the dip tube sealer is of two parts.

FIGS. 4*a* and 4*b* are partial cross-sectional views of still another embodiment.

FIG. 5 is a partial cross-sectional view of still another embodiment used on an aerosol valve.

FIG. 6 is a cross-sectional view of a version of the embodiment of FIGS. 4*a* and 4*b* used on a ball valve.

Similar reference characters refer to similar parts throughout the several views of the drawings.

DETAILED DESCRIPTION OF THE PREFERRED EMBODIMENT

Figure 1:
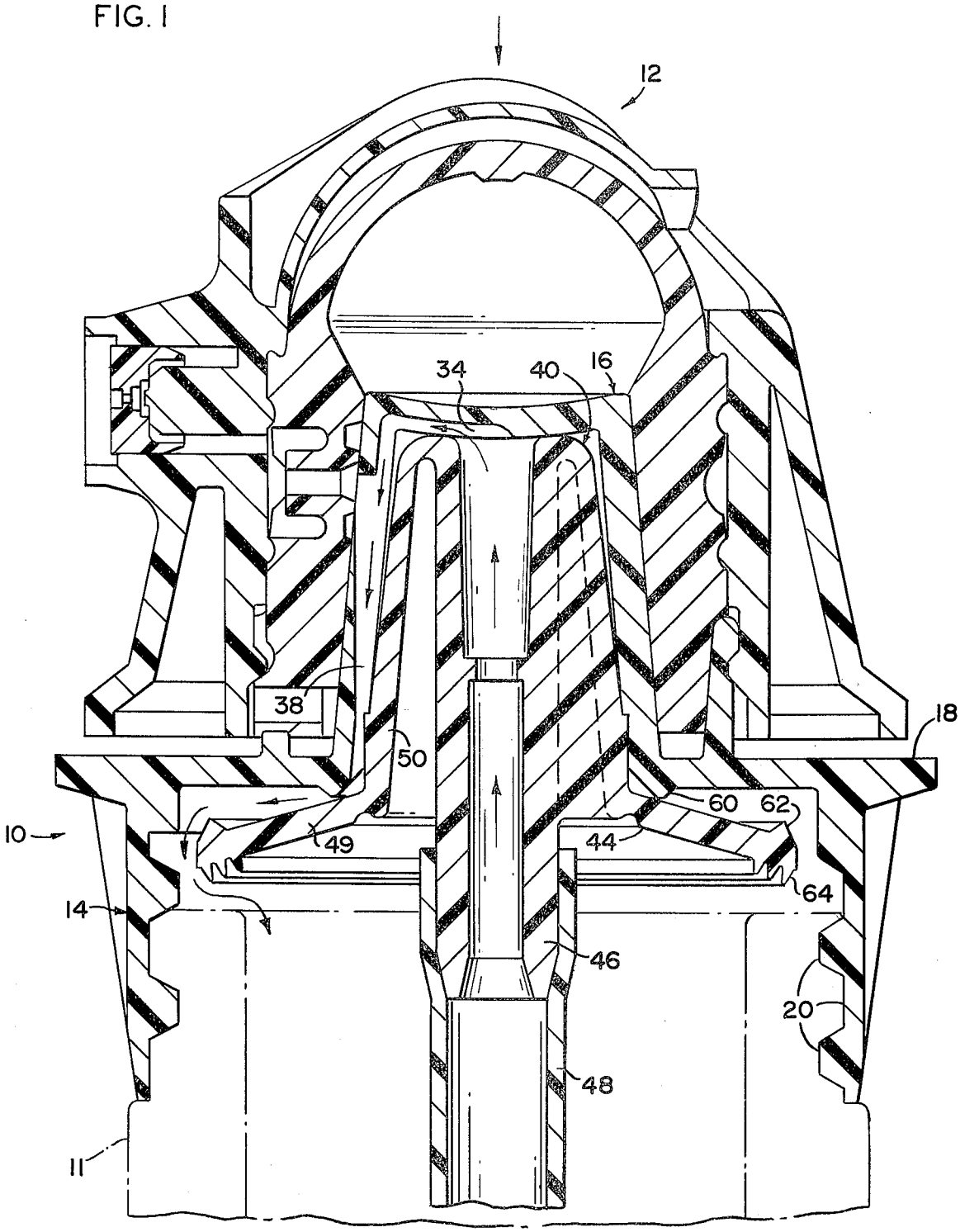
FIG. 1 shows a cross-sectional side view of the self prime mechanism of this invention in combination with a finger pump dispenser, and with the dip tube sealer in the open position.

The invention, as best seen in FIG. 1, comprises a self priming mechanism generally indicated as 10 for an open top container 11 only partially shown for use with a dispenser such as the finger pump shown and generally indicated as 12. Although a particular finger pump 12 is shown, any number of other dispensers may be used with the self priming mechanism 10.

As shown, the mechanism 10 comprises a cap for the dispenser with a dip tube sealer housing 16. The cap 14 has a base 18 with fastening means such as screw threads 20 on the interior of its side wall.

The dip tube sealer housing 16 has a feedback recess 34 formed on its ceiling and a feedback depression 38 on the inner surface of its wall.

The dip tube sealer generally indicated as 40, is contained within the dip tube sealer housing 16. It comprises a collar 44 and dip tube tail 46 with dip tube 48 mounted thereon. The collar 44 may be of one (see FIGS. 1, 2 and 5) or two-piece construction (FIGS. 3 and 4).

In both types of construction, there is a seal ring 49 and a sealer body 50. As shown in FIGS. 1 and 2, ring and body 50 are integral, and of flexible material, the ring 49 having an outward downward sloping configuration. In FIGS. 3*a* and 3*b*, ring 49 and body 50 are of two piece construction, with ring 49 also sealing against dip tube tail 46 of sealer body 50. Ring 49 has its own dip tube tail 51. p In FIGS. 4*a* and 4*b*, ring 49 is separate from body 50, has an outward sloping configuration and seals against the body 50 as well as container 11. In FIG. 5, ring 49 is integral with body 50 and is positioned to sealingly engage sealing bushing 52. Seal 54 engages the lower portion of valve body 90 in seaing engagement with channel 91. In FIG. 6, ring 49 comprises a ring configuration, and the dispenser body 56 constitutes a portion of the sealer body 50.

In FIGS. 1 and 2, when the cap 14 is threaded home on contaner 11, three seals 60 on the inside surface of sealer housing 16, 62 and 64 of the seal ring 50 coact to seal off fluid flow from the interior of the dip tube to the head space of the container 11. The ring 49 and sealer body 50 may be of flexible material whereby ring 49 bends upwardly as shown by directional arrow 39 in FIG. 2 alternately ring 49 may be of rigid material whereby the integral ring 49 moves upward along with body 50 as the cap 14 is threaded home.

In FIGS. 3*a* and 3*b*, seals 70, 72, 74 and 76 are involved. Seal 76 moves up and abuts against the lower end of dip tube tail 46. Seals 70 and 72 abut against the inside of cap 18 while seal 74 abuts against the upper end of container 11. In coaction, these seals seal off the interior of the dip tube 48 from the head space when cap 18 is fastened home.

In FIGS. 4*a* and 4*b*, seals 80, 82 and 84 perform a substantially similar function as seals 76, 72 and 74, respectively.

In FIG. 5, ring 49 when sealed is positioned in engaged sealing relation to sealing gasket 52. Sealer body 50 is correspondingly configured to fit in mating relationship with aerosol valve body 90. More specifically, seal 54 is disposed relative to valve body 90 and channel means 91 to seal off flow of fluid from the interior of dip tube 93 from the head space when mounting cup 92 is crimped onto the aerosol can.

In FIG. 6, seals 100, 102 and 104 are disposed in sealing engagement with the top edge of container 11, and the inside surface of the dispenser body 56 and lower end of sealer body 50, respectively.

As described above, the dip tube sealer 40 is movable from a first or open position, to a second or closed sealed position.

To assemble, the self priming mechanism 10 with a dispensing device 12 attached thereto are placed into the opening of the container. In this position, the dip tube 48 extends down into the product. In the open position, air trapped in dip tube 48 is permitted to flow through feedback recess 34 and feedback passage 38 back through the unsealed elements of sealer 40 into the head space of the container 11. As the seler 40 is secured to the container the upper rim of the container and the other elements of the dispenser or sealer engage their seal to isolate the interior of the dip tube 48 from the feedback means to thereafter permit actuation of the dispenser. In the closed or second sealed position, the dispenser operates normally with a minimum prime in that the air normally trapped in the dip tube has been fed back through the feedback means as previously described.

It will thus be seen that the objects of this invention, among those made apparent from the preceding description, are efficiently attained, and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described, what is claimed is:

1. A self prime mechanism for use with a dispenser which utilizes a dispensing means of the type having a dip tube, said self prime mechanism comprising: a container attachment means, a dip tube sealer comprising a collar and a dip tube tail, a feedback passage disposed in communicating relation from the interior of said dip tube to the head space of the dispenser, said collar being positioned in said feedback passage, said dip tube sealer being movable between an open and a sealed position as said container attachment means is sealed to the container, whereby air trapped in said dip tube is permitted to flow back into said head space before said container means is sealed.

2. The mechanism of claim 1 wherein said collar is of ring shape.

3. The mechanism of claim 2 wherein said collar is flexible.

4. The mechanism of claim 1 wherein said collar comprises a seal ring and a sealer body.

5. The mechanism of claim 4 wherein said seal ring and sealer body are integral.

6. The mechanism of claim 4 wherein said sealer body has a dip tube tail and said seal ring acts as a seal against said tail, said seal ring having a dip tube tail to which said dip tube of said dispensing means is affixed.

7. The mechanism of claim 1 wherein said collar is of open-bottom shape.

8. The mechanism of claim 7 wherein the upper rim of the cup and the lower open-bottom acts to seal against the dispenser and dispensng means respectively.

9. The mechanism of claim 8 wherein said sealer body constitutes a portion of the body of the dispensing means.

* * * * *

UNITED STATES PATENT OFFICE

CERTIFICATE OF CORRECTION

Patent No. 3,938,711 Dated February 17, 1976

Inventor(s) Ronald F. Ewald, et al

It is certified that error appears in the above-identified patent and that said Letters Patent are hereby corrected as shown below:

Column 2, line 68, after "51." delete "p"

Column 3, line 6, change "seaing" to -- sealing. --

Column 3, line 52, change "seler" to -- sealer"

Column 4, line 48, after "bottom" add -- cup --.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*